United States Patent [19]

Wallington et al.

[11] 4,129,838

[45] Dec. 12, 1978

[54] SWITCHING ARRANGEMENTS

[75] Inventors: John R. Wallington, London; Robert B. Greed, Colchester, both of England

[73] Assignee: The Marconi Company Limited, Chelmsford, England

[21] Appl. No.: 796,750

[22] Filed: May 13, 1977

[30] Foreign Application Priority Data

May 15, 1976 [GB] United Kingdom ..... 20137/76

[51] Int. Cl.[2] ..... H01P 1/15

[52] U.S. Cl. ..... 333/7 D; 333/97 S

[58] Field of Search ..... 333/7 D

[56] References Cited

U.S. PATENT DOCUMENTS

| | | | |
|---|---|---|---|
| 3,833,866 | 9/1974 | Boutelant | 333/7 D |
| 3,982,212 | 9/1976 | Wallington et al. | 333/7 D |
| 4,031,488 | 6/1977 | Beno | 333/7 D X |

*Primary Examiner*—Paul L. Gensler

*Attorney, Agent, or Firm*—Diller, Ramik & Wight

[57] ABSTRACT

A versatile switch for routing very high frequency signals is formed in microstrip. Each switch has four ports, and a number of switches can be interconnected to provide complex routing or power splitting functions.

14 Claims, 3 Drawing Figures

SWITCHING ARRANGEMENTS

This invention relates to switching arrangements which are suitable for providing a routing function for very high frequency electrical signals.

According to this invention, a switching arrangement includes a switching device having four microstrips serially interconnected to form a closed loop with an input or an output port being provided at the junction between each two adjacent microstrips, and a three dB splitter at two alternate ports in the loop, each microstrip including a variable impedance P.I.N. diode positioned a quarter wavelength (or an odd multiple thereof) from a port.

A switching arrangement in accordance with this invention is intended to be used for switching a restricted band of frequencies, the centre frequency of which determines the quarter wavelength spacing of the P.I.N. diodes.

The lengths of each of the four microstrips are preferably equal. Although each of said microstrips may contain only a single P.I.N. diode, preferably each microstrip contains a plurality of P.I.N. diodes. Where each of said microstrips contains a single P.I.N. diode, its overall electrical length is preferably a half wavelength. Where a plurality of P.I.N. diodes are included in each microstrip, preferably they are spaced apart from one another by a quarter wavelength.

Preferably, each microstrip contains three P.I.N diodes arranged such that its overall electrical length is equal to one wavelength.

Preferably, where only two 3dB splitters are provided they are connected to the two input ports. However, preferably the output ports can also be provided with 3dB splitters, and their use permits greater versatility in the functions available to the switching arrangement.

Preferably, each 3dB splitter is provided with a resistor between a pair of microstrip arms, the resistance being twice the value of the microstrip line impedance.

Preferably again, each of the said microstrip arms is provided with a switchable matched load having a resistance equal to the line impedance.

Figure 1:
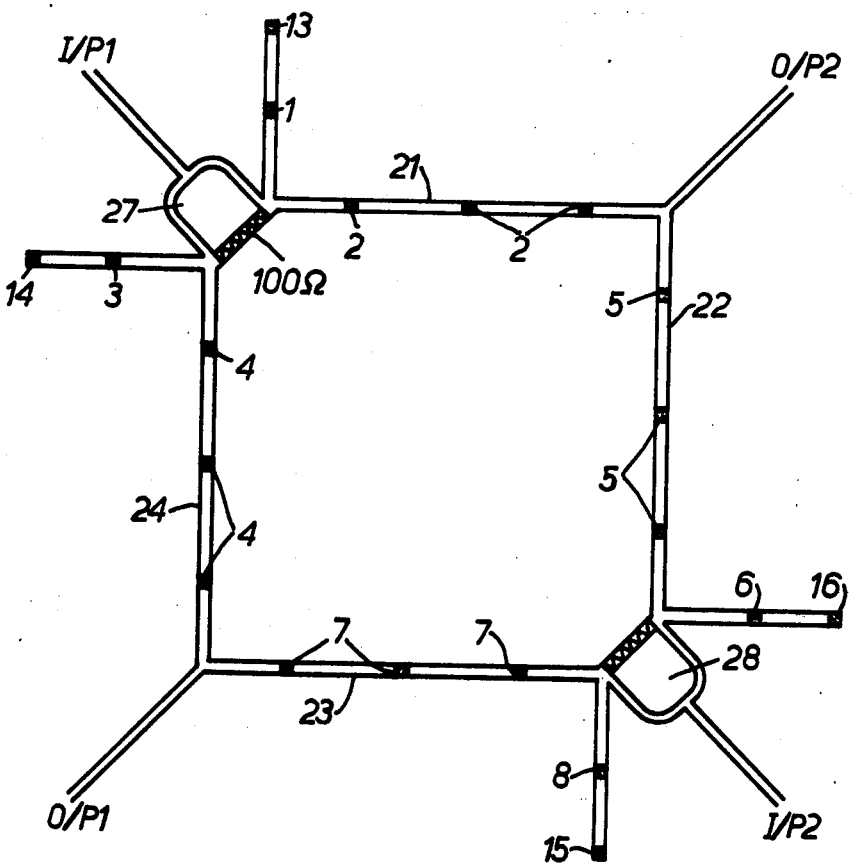
Figure 2:
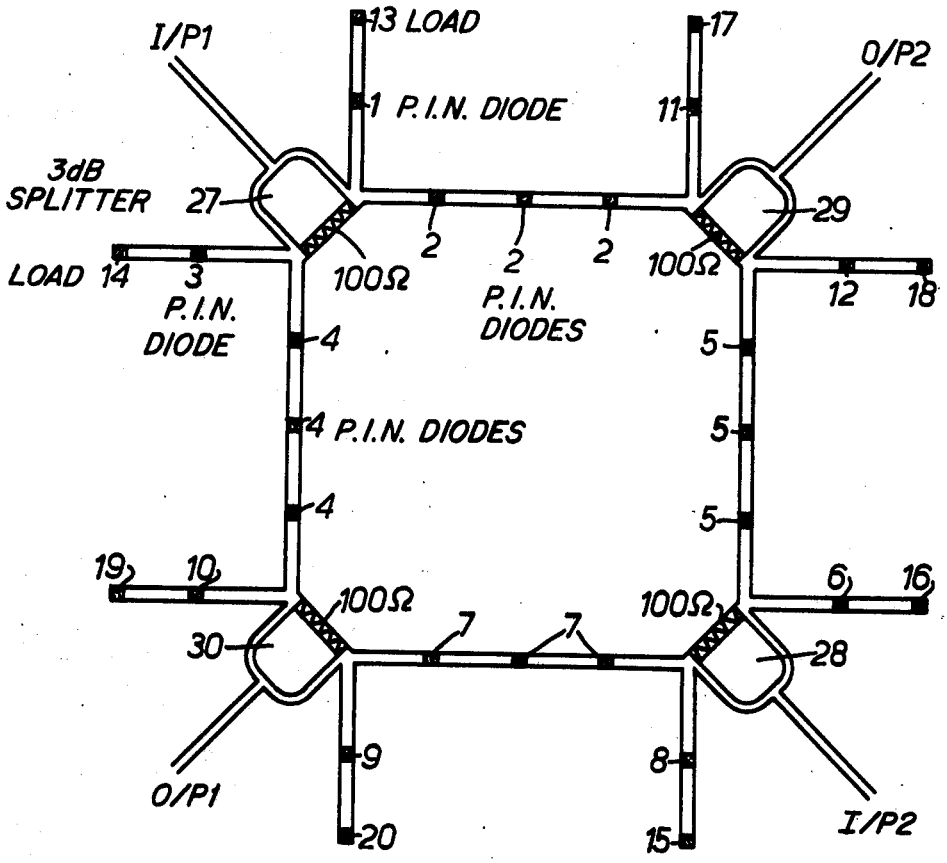
Figure 3:
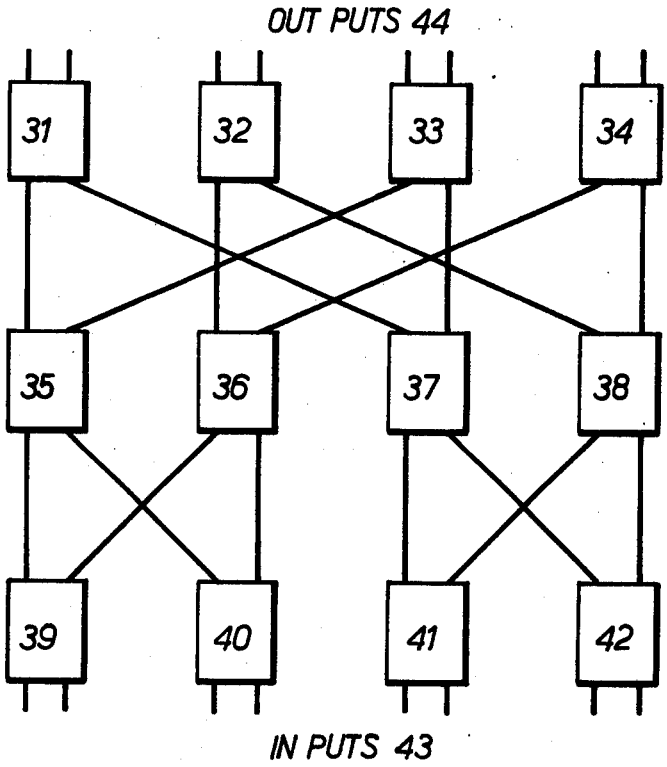

The invention is further described, by way of example, with reference to the accompanying drawings in which, FIG. 1 illustrates one switching device in accordance with the present invention, FIG. 2 illustrates an alternative embodiment of the invention, in which a four port switching device is provided with four 3dB splitters, and FIG. 3 shows a switching arrangement consisting of twelve interconnected switching devices.

In the preferred embodiments, the switching devices consist of microstrip lines on one surface of an alumina substrate having a conductive layer on its other face. The construction and transmission properties of such microstrip lines are now well known and so will not be described in greater detail.

The invention is suited to the transmission of very high frequency signals, of the order of a few gigahertz for example.

Referring to FIG. 1, four microstrip lines 21, 22, 23 and 24 are connected in series to form a closed loop. Input ports I/P1 and I/P2 are connected via 3dB splitters 27 and 28 to the junctions between lines 21 and 24, and between 22 and 23 respectively. The length of each line is equal to one wavelength at the operating frequency, and in each of the four lines three P.I.N. diodes 2, 4, 5, 7 are placed quarterwavelengths apart to control the transmission properties of that line.

Matched loads 13, 14, 15, 16 are connected to the 3dB splitters 27 and 28 as shown, to correctly terminate the input port I/P1 or I/P2 which is not energised when the splitting mode (which is described later) is in use.

By controlling the impedance of the diodes, signals applied to either input can be routed to either output. In addition, either of the input signals can be split between the two outputs. The four states available all result in an inherent 3dB insertion loss.

The diodes used are high frequency P.I.N. diodes which have low capacitance and can switch very rapidly from one conductive state to the other. The microstrip used has a characteristic impedance of 50Ω, and the two terminating loads for each 3dB splitter also have a value of 50Ω. Each load is mounted at the end of a microstrip half a wavelength long. The 3dB splitters each consist of two branching arms as shown linked by a 100Ω resistance.

With diodes 1, 4, 5 and 8 forward biassed and diodes 2, 3, 6 and 7 reverse biassed input 1 is connected to output 2 and input 2 is connected to output 1. If an opposite bias is applied, the connections are reversed such that input 1 is connected to output 1 and input 2 is connected to output 2. With diodes 1, 3, 5 and 7 forward biassed and diodes 2, 4, 6 and 8 reversed biassed input 1 is split between the two output ports, and input 2 is terminated by the two matched loads 15 and 16. Similarly, if the diode biasses are interchanged then input 2 is split between the two outputs, and input 1 is terminated by the matched loads 13 and 14.

An alternative switching circuit is shown in FIG. 2, where like references as in FIG. 1 are used for like parts. It differs from FIG. 1 by the provision of the two additional 3dB splitters 29 and 30 with corresponding matched loads 17, 18 and diodes 11, 12 for splitter 29, and matched loads 19, 20 and diodes 9, 10 for splitter 30.

With diodes 1, 4, 5 and 8 to 12 forward biassed and the others reverse biassed input 1 is connected to output 2, and input 2 is connected to output 1. With diodes 2, 3, 6, 7 and 9 to 12 forward biassed and all others reverse biassed input 1 is connected to output 1, and input 2 is connected to output 2. For the forward splitting mode, if diodes 1, 3, 5, 7 and 9 to 12 are forward biassed and all others reverse biassed input 1 is split between output 1 and output 2, and input 2 is correctly terminated by means of the two loads 15, 16. Forward bias on diodes 2, 4, 6 and 8 to 12 connects input 2 to both outputs, and input 1 is terminated by load 13 and 14. To produce a reverse splitting mode diodes 2, 3, 5, 8, 9 and 10 are forward biassed and all others are reverse biassed. Inputs 1 and 2 are now both connected to output 1, and output 2 is terminated internally by means of loads 17 and 18.

If all diodes are changed to the opposite bias inputs 1 and 2 are connected to output 2 and output 1 is terminated internally by loads 19 and 20. If diodes 1 to 8 are reverse biassed and diodes 9 to 12 are forward biassed both inputs are connected to both outputs. In all seven switching states there is an inherent 6dB loss due to the splitters.

The required states are controlled by producing logic signals to switch the various diodes in the required combinations.

By interconnecting a plurality of switch devices of the kind shown in FIG. 1 or FIG. 2 various complex routing functions including a broadcast function can be achieved. In addition, switches as shown in FIG. 2 can produce a combining function, i.e. signals present at all the inputs can be combined to appear at a single selected output; this can also be referred to as a reverse splitting mode.

In particular, any number of switch elements greater than twelve can be interconnected to provide switching between four inputs and four outputs. For a greater number of elements, redundancy is available to increase the reliability of the network. An example is shown in FIG. 3 in which a high frequency switching arrangement consists of twelve interconnected switching devices 31 to 42. A signal applied to any input 43 can be routed to any output 44, or can be split equally between all or any number of the outputs. Conversely signals present at the inputs can be combined to appear at any one or more output.

We claim:

1. A switching arrangement including a switching device having four microstrips serially interconnected to form a closed loop with a port being provided at the junction between each two adjacent microstrips, and a 3dB splitter at two alternate ports in the loop, each microstrip including a variable impedance P.I.N. diode positioned at intervals $n\lambda/4$, n being an odd integer, from a port and each of the two 3dB splitters being provided with two selectable matched loads which are coupled to respective ones of the two microstrips which are interconnected at that 3dB splitter.

2. A switching arrangement as claimed in claim 1 and wherein the lengths of each of the four microstrips are equal.

3. A switching arrangement as claimed in claim 1 and wherein each microstrip contains a plurality of P.I.N. diodes.

4. A switching arrangement as claimed in claim 1 and wherein each microstrip contains a single P.I.N. diode and its overall electrical length is a half wavelength.

5. A switching arrangement as claimed in claim 1 and wherein a plurality of P.I.N. diodes are provided in each mircostrip, and they are spaced apart from one another by a quarter wavelength.

6. A switching arrangement as claimed in claim 5 and wherein each microstrip contains three P.I.N. diodes arranged such that its overall electrical length is equal to one wavelength.

7. A switching arrangement as claimed in claim 1 and wherein said two 3dB splitters are connected to two input ports.

8. A switching arrangement as claimed in claim 1 and wherein a 3dB splitter is provided at each of the four ports.

9. A switching arrangement as claimed in claim 7 and wherein each 3dB splitter is provided with a resistor between a pair of microstrips, the resistance being twice the value of the microstrip line impedance.

10. A switching arrangement as claimed in claim 8 and wherein each 3dB splitter is provided with a resistor between a pair of microstrips, the resistance being twice the value of the microstrip line impedance.

11. A switching arrangement as claimed in claim 1 and wherein each switchable matched load has a resistance equal to the line impedance.

12. A switching arrangement comprising a plurality of interconnected switching devices as claimed in claim 1.

13. A switching arrangement as defined in claim 1 wherein a P.I.N. diode is provided for each matched load.

14. A switching arrangement comprising, in combination:

four microstrips serially interconnected to define a closed loop having a port communicating with the junction between each two adjacent mircostrips;

at least two 3dB splitters associated with said microstrips to define alternate ones of said ports, one of said splitters having branches respectively connected to adjacent ends of one pair of said microstrips and the other splitter having branches respectively connected to adjacent ends of the other pair of said microstrips, each splitter including a line leading from each juncture between a branch thereof and a microstrip and each line terminating in a matched load;

first P.I.N. diode means in each microstrip for selectively switching each microstrip between low and high impedance states and second P.I.N. diode means in each of said lines for selectively connecting a corresponding matched load to said loop.

* * * * *